US006695442B2

(12) United States Patent
Kitahara

(10) Patent No.: US 6,695,442 B2
(45) **Date of Patent: *Feb. 24, 2004**

(54) INK JET HEAD HAVING STRUCTURE FOR ELIMINATING AIR BUBBLES AND REDUCING CROSSTALK AND A PRINTER CONTAINING THE INK HEAD

(75) Inventor: Tsuyoshi Kitahara, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/305,716

(22) Filed: May 5, 1999

(65) Prior Publication Data

US 2003/0107619 A1 Jun. 12, 2003

(30) Foreign Application Priority Data

Jul. 17, 1998 (JP) ..... 10-203353

(51) Int. Cl.[7] ..... B41J 2/19; B41J 2/045
(52) U.S. Cl. ..... 347/92; 347/68
(58) Field of Search ..... 347/92, 30, 35, 347/68, 70, 71

(56) References Cited

U.S. PATENT DOCUMENTS

| | | | | | |
|---|---|---|---|---|---|
| 4,459,601 | A | | 7/1984 | Howkins | |
| 5,119,116 | A | * | 6/1992 | Yu | 347/65 |
| 5,502,479 | A | * | 3/1996 | Ishinaga et al. | 347/93 |
| 5,699,095 | A | * | 12/1997 | Mitsuzawa et al. | 347/92 |
| 6,039,437 | A | * | 3/2000 | Tsujimoto | 347/92 |
| 6,120,139 | A | * | 9/2000 | Childers et al. | 347/92 |
| 6,174,049 | B1 | * | 1/2001 | Tachihara et al. | 347/92 |

FOREIGN PATENT DOCUMENTS

| | | | | | |
|---|---|---|---|---|---|
| EP | 0 677 386 | A2 | | 10/1995 | |
| EP | 0 738 599 | A2 | | 10/1996 | |
| EP | 0 761 447 | A2 | | 3/1997 | |
| GB | 2 314 293 | A | | 12/1997 | |
| JP | 58-142865 | A | * | 8/1983 | 347/92 |
| JP | 02-187353 | A | * | 7/1990 | B41J/2/05 |
| JP | 3-268946 | | | 11/1991 | |

(List continued on next page.)

OTHER PUBLICATIONS

Patent Abstracts of Japan, vol. 014, No. 469 (M–1034), Oct. 12, 1990 & JP 02 187353 A (Canon Inc.), Jul. 23, 1990 Abstract.

(List continued on next page.)

*Primary Examiner*—Judy Nguyen
(74) *Attorney, Agent, or Firm*—Sughrue Mion, PLLC

(57) ABSTRACT

The present invention prevents bubbles from remaining in an ink passage and inhibits crosstalk when ink is jetted in an ink-jet print head. Ink-jet nozzles are formed inside a nozzle plate in the front of the ink-jet print head, a plurality of pressure chambers are provided at the rear of the nozzle plate, and an ink reservoir is connected to the pressure chambers. An ink supply passage has an exit which is connected to the ink reservoir. The diameter of the ink supply passage is reduced at the exit connected to the ink reservoir, and the diameter at the exit is smaller than the width and the depth of the ink reservoir. The rear surface of the ink reservoir is covered with a flexible and elastic film, except for a connection between the ink reservoir and the exit of the ink supply passage, at a location remote from a connection between the ink reservoir and each of the pressure chambers. The exit of the ink supply passage absorbs the pressure of an ink jet from each of the pressure chambers.

29 Claims, 10 Drawing Sheets

FOREIGN PATENT DOCUMENTS

| | | |
|---|---|---|
| JP | 6-8422 | 1/1994 |
| JP | 7-156396 | 6/1995 |
| JP | 7-276-627 | 10/1995 |
| JP | 8-332725 | 12/1996 |
| JP | 9-226112 | 9/1997 |
| WO | WO 88/05726 | 8/1988 |

OTHER PUBLICATIONS

Patent Abstracts of Japan, vol. 006, No. 181 (M–156), Sep. 17, 1982, & JP 57 087962 A (Canon Inc.), Jun. 1, 1982 Abstract.

* cited by examiner

INK JET HEAD HAVING STRUCTURE FOR ELIMINATING AIR BUBBLES AND REDUCING CROSSTALK AND A PRINTER CONTAINING THE INK HEAD

The present invention relates to a ink-jet print head and ink-jet printer which prevents bubbles from being trapped within the ink supply passage of an ink-jet head preventing ink from flowing smoothly and being normally jetted from the ink nozzles, and which prevents crosstalk from occurring when vibration due to pressure is caused in the ink supply passage, resulting in fluctuation in the ink jetting speed and preventing ink from being driven from the ink nozzles.

BACKGROUND OF THE INVENTION

FIG. 1 shows a typical cross-sectional composition of a conventional ink-jet print head 1. A nozzle plate 2 in the front of the head 1 is provided with multiple ink jetting nozzles 3 arranged in a direction which lies perpendicular to the page. Multiple pressure chambers 5, also arranged in a direction perpendicular to the page, and respectively communicating with each nozzle 3, and a common ink reservoir 7 (extended along the direction perpendicular to the page, along the line of the pressure chambers 5) for supplying ink to each pressure chamber 5, are provided to the rear of the nozzle plate 2. An ink supply passage 9 for carrying ink from an ink cartridge (not shown) is connected to the ink reservoir 7 through the casing 11 of the head 1. Normally, the ink supply passage 9 is connected to the center of the ink reservoir 7 which is extended along in the direction perpendicular to the page.

The rear surface of each pressure chamber 5 and the ink reservoir 7 is covered with a flexible or an elastic film 13, and a rigid reinforcing plate 15, such as a stainless steel plate, is laminated on the film 13. FIG. 2 is a sectional view showing the reinforcing plate 15 viewed along a line A—A in FIG. 1. (The cross-section of the head shown in FIG. 1 is viewed along a line B—B in FIG. 2.) As shown in FIG. 2, plural apertures 17, 19, and 21, are formed inside the reinforcing plate 15 by etching. The rectangular aperture 17 is provided at the rear of the line of pressure chambers 5, the circular hole 19 in the center of the plate 15 corresponds to the exit to the reservoir 7 of the ink supply passage 9, and the wing-type apertures 21 on both sides of the circular hole 19 is provided at the rear portion of the plate 15, except for the center of the reservoir 7. Multiple rectangular insulating parts 18 existing inside the rectangular aperture 17 are respectively located at the rear of the individual pressure chamber 5.

Referring to FIG. 1 again, each end of the parts in the shape of the teeth of a comb divided into multiple parts of a piezoelectric element 23, is bonded to the film 13 at the rear of each pressure chamber 5 via each insulating part 18 shown in FIG. 2. The piezoelectric element 23 is fixed to the casing 11, the film 13 of each pressure chamber 5 is reciprocated because each part like a tooth of a comb of the piezoelectric element 23 is expanded or contracted according to a signal from a cable 25, and pressure is generated in each pressure chamber 5 and ink is jetted from each nozzle 3. Simultaneously, ink is also jetted from the pressure chamber 5 into the reservoir 7; however, the film 13 covering the rear surface of the reservoir 7 absorbs the pressure of the jet.

Bubbles may be included in ink which flows from the ink cartridge to the reservoir 7 through the supply passage 9. The bubbles may grow to a size equal to the diameter of the supply passage 9 in the worst case, and such a large bubble may be trapped in the vicinity of a connection between the supply passage 9 and the reservoir 7 and may remain there. As a result, ink does not flow smoothly and ink cannot be normally jetted from each nozzle 3.

When ink is jetted, an ink jet from the pressure chamber 5 functions as a trigger in the reservoir 7, and an MC circuit composed of the compliance C of the film 13 at the back of the reservoir and the inertance M of the ink supply passage 9 is oscillated, and vibration due to pressure may be caused. As a result, a problem called crosstalk, such as the fluctuation of the ink jetting speed and the jet of ink from the nozzle 3 being not driven, is caused.

It is when a nozzle 3 in the vicinity of the center of a nozzle train is driven that crosstalk is easily caused. The reason is as follows: in this case, ink is jetted from the pressure chamber 5 in the vicinity of the center to the center of the reservoir 7, that is, the vicinity of a connection between the reservoir and the ink supply passage 9. However, as the rear surface in the vicinity of the center of the reservoir 7 is covered with the peripheral part 15A (a required location for bonding to the peripheral part of the exit of the ink supply passage 9) of the exit hole 19 of the ink supply passage 9 inside the reinforcing plate 15 as shown in FIG. 2, a jet of ink is trapped. Therefore, a problem that a high-pressure wave is generated in the center and is propagated to the periphery, and ink is jetted from a nozzle from which ink is not to be jetted, is caused.

SUMMARY OF THE INVENTION

Therefore, the object of the present invention is to prevent bubbles from remaining in an ink passage of an ink-jet print head.

Another object of the present invention is to inhibit crosstalk when ink is jetted.

An ink-jet print head according to one standpoint of the present invention is provided with a plurality of ink jetting nozzles arranged in line, a plurality of pressure chambers respectively communicating with each nozzle and arranged in line, an ink reservoir extended along the line of the pressure chambers and communicating with the pressure chambers in common and provided with a predetermined width and depth, and an ink supply passage communicating with the ink reservoir. The diameter of the ink supply passage is reduced at the exit to the ink reservoir, compared with the part of the ink supply passage on the upstream side of the exit.

According to the above ink-jet print head, as the flow velocity of ink is increased at the exit of the ink supply passage where the diameter is reduced, bubbles are easily pushed out and as bubbles are reduced, few bubbles remain.

In a preferred embodiment, the width at the exit of the ink supply passage is made smaller than the width and depth of the ink reservoir. Thereby, bubbles can more easily pass the ink reservoir and the effect of preventing bubbles from remaining in the ink supply passage is further enhanced. It is desirable that the width of the ink reservoir is larger than the depth.

Also, in the preferred embodiment, the exit of the ink supply passage is arranged at an edge on the reverse side to the side of the pressure chamber in the center of the ink reservoir, in a direction along the line of the pressure chambers, and the width at the exit of the ink supply passage is smaller than the width of the ink reservoir. Therefore, the exit of the ink supply passage is located off an area in the vicinity of the pressure chamber of the ink reservoir. The area in the vicinity of the pressure chamber of the ink reservoir is covered with a flexible film in a state in which the film is deformable and the area covered with the film continues in an overall range from one end along the line of the pressure chambers to the other end. According to the above arrangement, the pressure of an ink jet from any pressure chamber is effectively absorbed by the flexible film and crosstalk is reduced.

To reduce crosstalk, it is desirable that the compliance of the flexible film covering the ink reservoir is large and the inertance of the ink supply passage is small. From this viewpoint, it is desirable that the width of the ink reservoir is larger than the depth, and that the diameter of the ink supply passage in the part except the exit, is thicker than the diameter at the exit.

An ink-jet print head according to a second embodiment of the present invention, includes a plurality of ink jetting nozzles arranged in line, a plurality of pressure chambers respectively communicating with each nozzle and arranged in line, an ink reservoir extended along the line of the pressure chambers and communicating with the pressure chambers in common and provided with a predetermined width and depth, a flexible film covering at least a part of the outer surface of the ink reservoir in a deformable state and an ink supply passage communicating with the ink reservoir. An area in which the flexible film covers the ink reservoir in a deformable state continues at least from one end of the line of the pressure chambers to the other end in the vicinity of the pressure chamber along the line of the pressure chambers.

An ink-jet print head according to a third embodiment of the present invention is provided with a plurality of ink jetting nozzles arranged in line, a plurality of pressure chambers respectively communicating with each nozzle and arranged in line, an ink reservoir extended along the line of the pressure chambers and communicating with the pressure chambers in common and provided with a predetermined width and depth, and an ink supply passage communicating with the ink reservoir. The exit of the ink supply passage is arranged on the reverse side to the side of the pressure chamber in the center of the ink reservoir.

An ink-jet print head according to a fourth embodiment of the present invention is provided with a plurality of ink jetting nozzles arranged in line, a plurality of pressure chambers respectively communicating with each nozzle and arranged in line, an ink reservoir extended along the line of the pressure chambers and communicating with the pressure chambers in common and provided with a predetermined width and depth, an ink supply passage communicating with the ink reservoir, and a flexible film for covering at least a part of the outer surface of the ink reservoir in a deformable state and acting so that the pressure of a jet of ink from each of the pressures chamber into the ink reservoir is absorbed thereby. The exit of the ink supply passage is arranged on the reverse side to the side of the pressure chamber in the center of the ink reservoir in a direction along the line of the pressure chambers, and the width at the exit of the ink supply passage is smaller than the width of the ink reservoir. Further, an area in which the flexible film covers the ink reservoir in a deformable state continues at least from one end of the line of the pressure chambers to the other end in the vicinity of the pressure chamber along the line of the pressure chambers.

According to the above ink-jet print head, the pressure of an ink jet from any pressure chamber is effectively absorbed by the flexible film and crosstalk is reduced.

The present invention further also provides an ink-jet printer provided with an ink-jet print head provided with the above structure, a carriage mechanism for moving the ink-jet print head, a paper feed mechanism for feeding paper, and a control circuit for driving and controlling these mechanisms.

DESCRIPTION OF THE PREFERRED EMBODIMENTS

Figure 3:
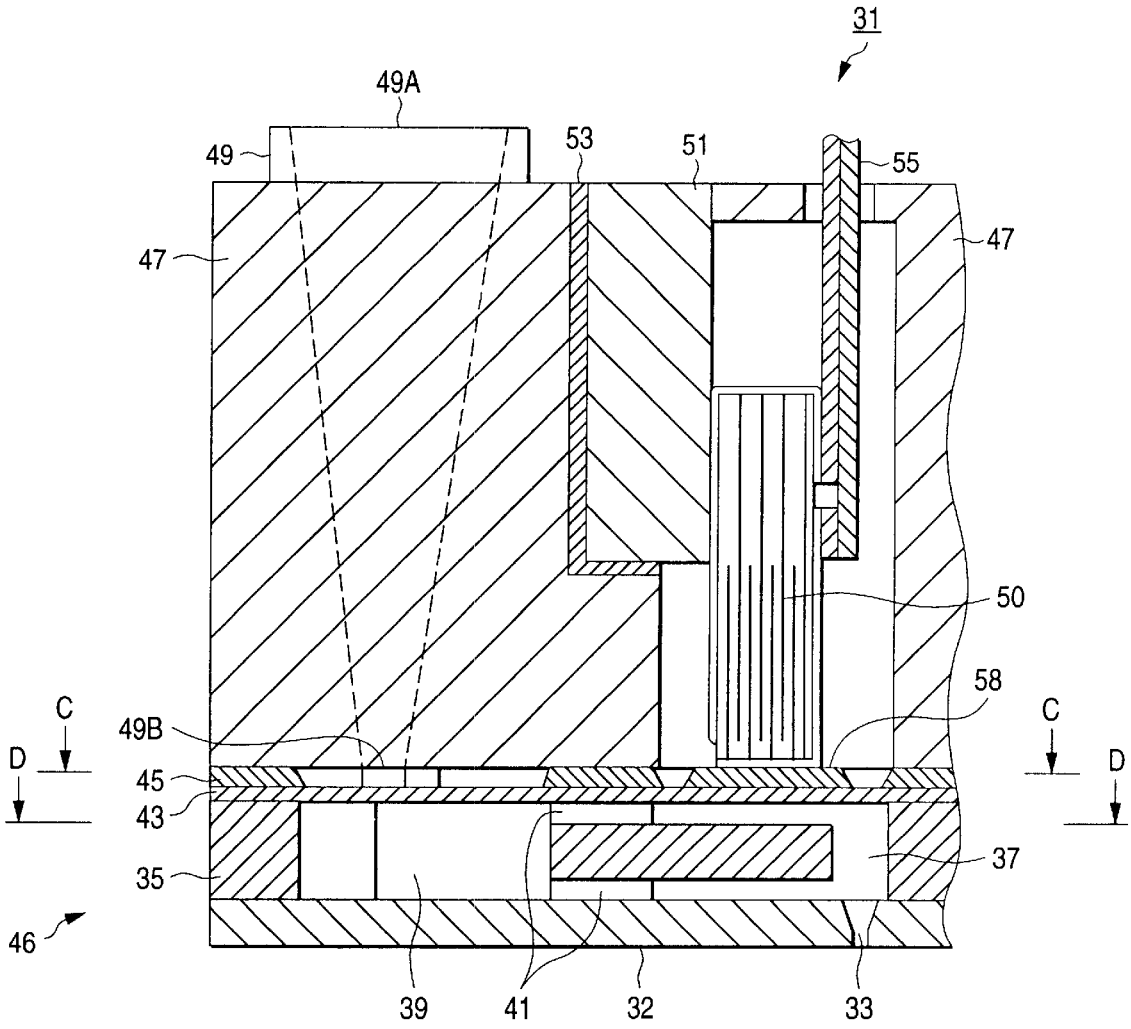
FIG. 3 is a sectional view showing an ink-jet print head equivalent to an embodiment of the present invention respectively viewed along lines E—E in FIGS. 4 and 5.

FIG. 3 shows the sectional composition of an ink-jet print head 31 equivalent to a first embodiment of the present invention.

A nozzle plate 32 located at the front of the head 31 is provided with multiple ink jetting nozzles 33 arranged in line in a direction perpendicular to the page. A spacer 35 made of silicon, for example, is bonded to the rear of the nozzle plate 32. Multiple pressure chambers 37 (arranged in line in the direction perpendicular to the page) respectively communicating with each nozzle 33 and a common ink reservoir 39 (extended in the direction perpendicular to the page along the arrangement of the pressure chambers 37) for supplying ink to the pressure chambers 37 are formed inside the spacer 35 by etching. Each pressure chamber 37 is connected to the reservoir 39 via a very thin passage 41.

A flexible and elastic film 43 made of resin or metal is stuck on the rear surface of the spacer 35 and covers the rear surface of the pressure chamber 37 and the reservoir 39. A reinforcing plate 45 which is as rigid as a stainless steel plate, is laminated at the rear of the film 43. A lamination composed of the above nozzle plate 32, spacer 35, film 43 and reinforcing plate 45 is called a passage unit 46. The casing 47 of the head 31 is bonded to the rear face of the passage unit 46. An ink supply passage 49 for carrying ink from an ink cartridge not shown pierces the casing 47 and is connected to the center of the ink reservoir 39 in the passage unit 46. The ink supply passage 49 is tapered from its entrance 49A connected to the ink cartridge to its exit 49B connected to the ink reservoir 39. Therefore, the cross-section of the ink supply passage 49 is the smallest at the exit 49B. This arrangement is helpful to prevent bubbles from remaining in the ink supply passage 49, as described later, and also contributes to increasing the compliance of the film 43 at the rear of the reservoir 39 and inhibiting crosstalk.

The end of each part divided into multiple parts like the teeth of a comb of a piezoelectric element 50 (extended along the line of the pressure chambers 37 in the direction perpendicular to the page) is bonded to the film 43 at the back of each pressure chamber 37 via an insulating part 58 described later of the reinforcing plate 45. The piezoelectric element 50 is fixed to a heavy holding block 51 made of stainless steel, for example, and the holding block 51 is fixed to the casing 47 with an adhesive 53 or other fixative. A signal cable 55 is connected to the piezoelectric element 50. The film 43 at the rear of each pressure chamber 37 is reciprocated, pressure is generated inside each pressure chamber 37, and ink is jetted from each nozzle 33, because each part in the shape of a tooth of a comb of the piezoelectric element 50 is expanded or contracted according to a signal applied via the cable 55. Simultaneously, although ink is jetted from the pressure chamber 37 into the reservoir 39, the pressure of the jet is absorbed by the film 43 covering the rear of the reservoir 39 more effectively than in a conventional type head shown in FIG. 1, as is described in detail below.

Figure 4:
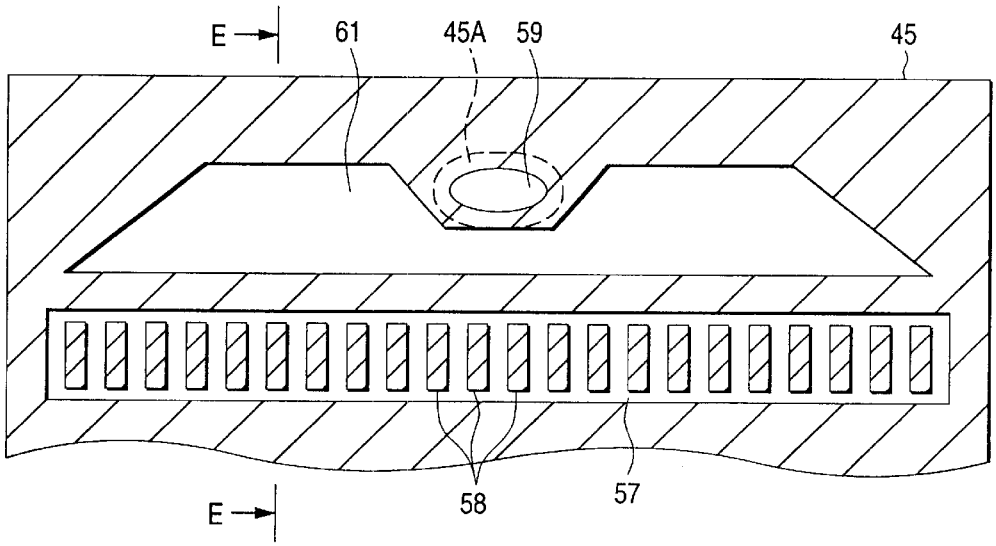
FIG. 4 is a sectional view showing a reinforcing plate 45 viewed along a line C—C in FIG. 3.
Figure 5:
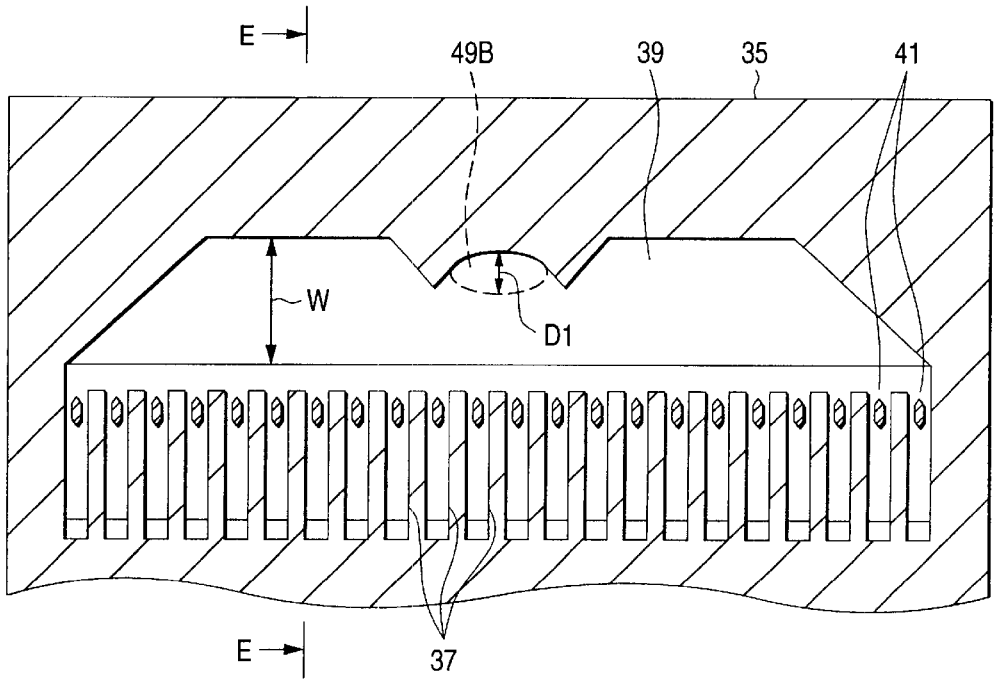
FIG. 5 is a sectional view showing a spacer 35 viewed along a line D—D in FIG. 3.

FIG. 4 is a sectional view showing the reinforcing plate 45 viewed along a line C—C shown in FIG. 3, and FIG. 5 is a sectional view showing the spacer 35 viewed along a line D—D shown in FIG. 3. (The sectional view of the head 31 viewed along each line E—E shown in FIGS. 4 and 5 is equivalent to the sectional view shown in FIG. 3).

As shown in FIG. 4, plural apertures 57, 59, and 61, are formed in the reinforcing plate 45 by etching. As clearly seen, when FIGS. 4 and 5 are compared, the rectangular aperture 57 of the reinforcing plate 45 is located at the rear of the line of the pressure chambers 37 inside the spacer 35, and multiple rectangular insulating parts 58 existing inside the rectangular aperture 57 are respectively located at the rear of the individual pressure chamber 37, and are provided between the following end of each part and the following film 43 to bond the end of each part in the shape of a tooth of a comb of the piezoelectric element 50 as described above, to the film 43 at the rear of each pressure chamber 37. The elliptical hole 59 shown in FIG. 4 is equivalent to the exit 49B of the supply passage 49 via which the reservoir 39 shown in FIG. 5 and the ink supply passage 49 are connected, and a part 45A encircled by a broken line around the elliptical hole 59 is provided to bond to the peripheral part of the exit 49B of the ink supply passage 49. The wing-type aperture 61 shown in FIG. 4, except the exit 49B of the supply passage 49, is located at the rear of the reservoir 39 shown in FIG. 5.

Figure 2:
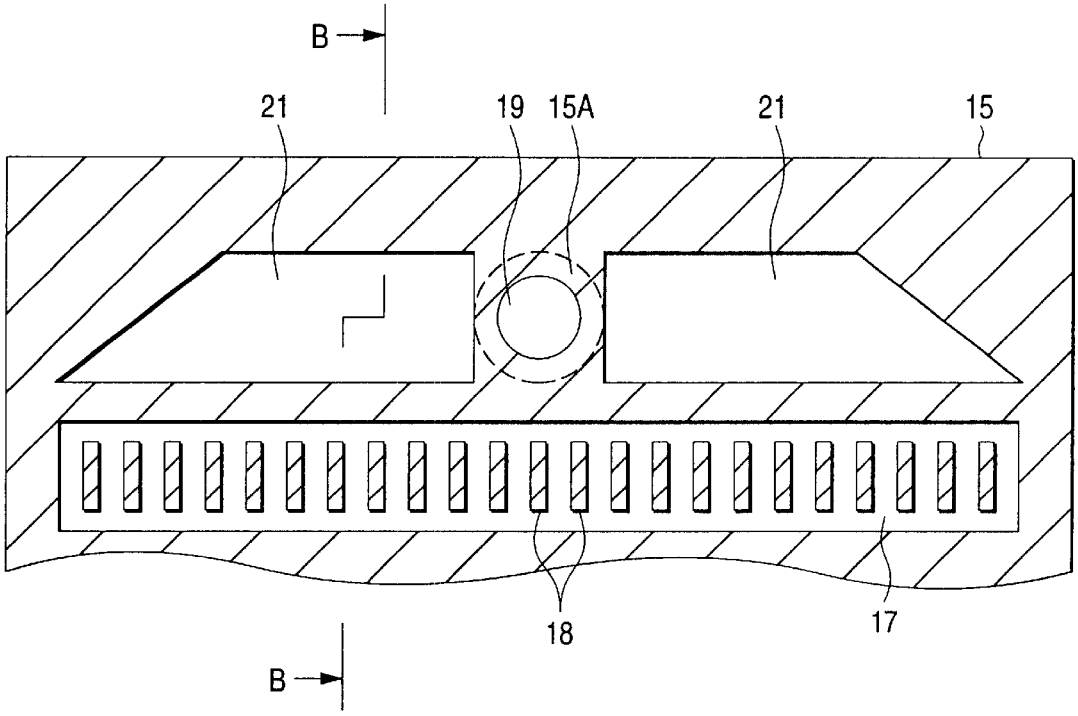
FIG. 2 PRIOR ART
FIG. 2 is a sectional view showing a reinforcing plate 15 viewed along a line A—A in FIG. 1.

It should be remarked that the wing-type aperture 61 at the rear of the reservoir 39 of the reinforcing plate 45 is not disconnected in the center as a conventional type wing-type aperture 21 as shown in FIG. 2, but continues overall from one end of the reservoir 39 to the other end along the line of the pressure chambers 37. (The film 43 is deformable in the area of the aperture 61 and acts so that the pressure of an ink jet from the pressure chamber 37 is absorbed, that is, is compliant.) Therefore, the width D1 (a diameter in the direction of width W) of the exit 49B of the supply passage is designed so that it is smaller than the width W of the reservoir 39, and the exit 49B of the supply passage 49 is arranged at the edge on the reverse side to the pressure chamber 37 of the reservoir 39, and is parted from the edge on the side of the pressure chamber 37. As the film 43 at the rear of the reservoir 39 can effectively absorb the energy of an ink jet owing to such an arrangement, even if ink is jetted from any pressure chamber 37 when ink is jetted, crosstalk is reduced.

Operation of this embodiment under the above arrangement will be described below.

Figure 1:
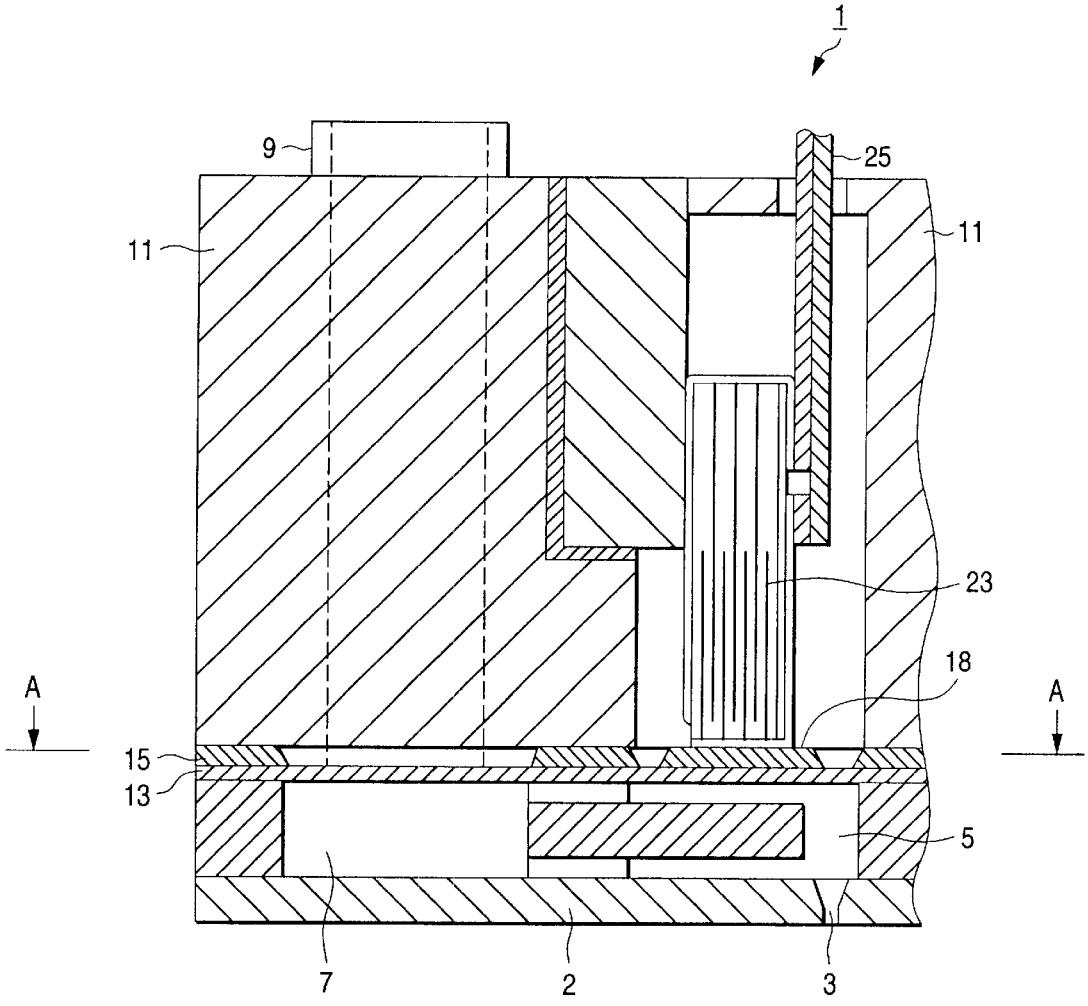
FIG. 1 PRIOR ART
FIG. 1 is a sectional view showing a conventional type ink-jet print head viewed along a line B—B in FIG. 2.
Figure 6:
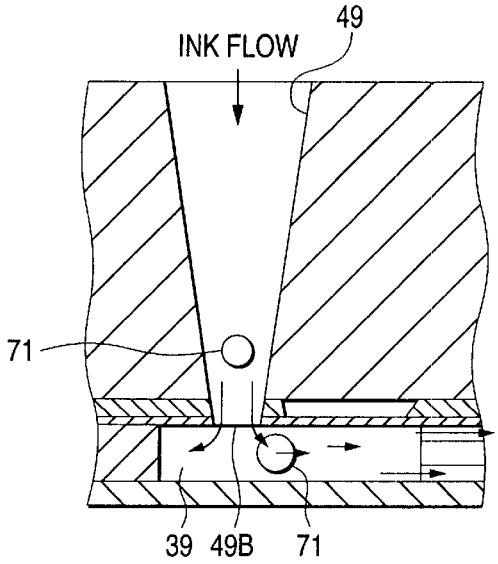
FIGS. 6(A) and 6(B) compare the flow of bubbles included in the ink between the head shown in the embodiment of FIG. 6(A), and the conventional type head shown in FIG. 6(B)
Figure 6:
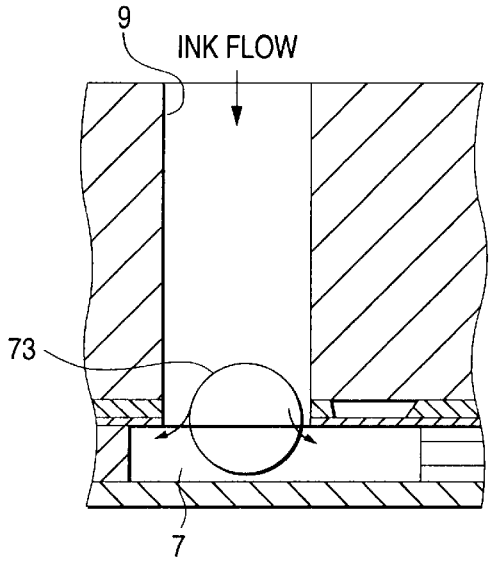

FIG. 6(A) shows the flow of bubbles included in the ink in the above embodiment and FIG. 6(B) shows the flow of bubbles in a conventional type head as shown in FIG. 1.

In this embodiment, as shown in FIG. 6(A), the area of the exit 49B of the ink supply passage 49 is smaller than the area shown in FIG. 6(B) of the exit of an ink supply passage 9 in the conventional type head. As flow velocity at the exit of the ink supply passage is in inverse proportion to the area of the exit if the flow rate of the ink is equal, flow velocity v1 at the exit of the ink supply passage in the first embodiment is faster than flow velocity v2 at the exit in the conventional type head. In the first embodiment, the closer the exit 49B is, the faster the flow velocity in the ink supply passage 49 becomes. Therefore, as the force which washes away bubbles in this first embodiment is stronger than such a force in the conventional type head, and in addition, the force which washes away the bubbles is the largest at the exit 49B of the ink supply passage 49 which is a corner where bubbles are easiest to be trapped, bubbles find it hard to remain there.

If a bubble grows to a size close to the diameter of the supply passage in the ink supply passage 9, the above large bubble 73 may hit the wall of the reservoir 7 and remain at the exit of the ink supply passage 9 in the conventional type head shown in FIG. 6(B). However, in this embodiment shown in FIG. 6(A), as the diameter at the exit 49B of the ink supply passage is small, the bubble 71 is also small and can readily pass the reservoir 39.

Figure 7:
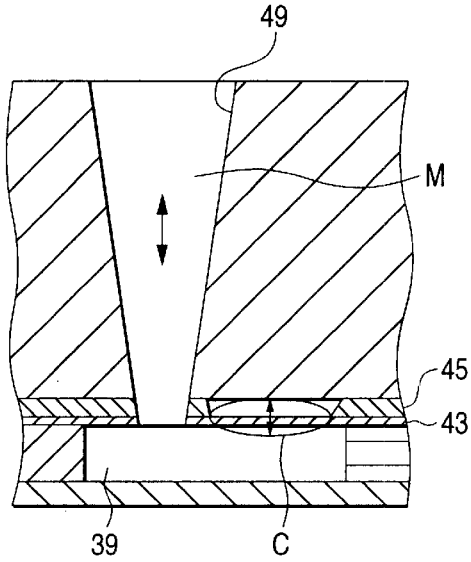
FIGS. 7(A) and 7(B) show the compliance C of a film 43 at the rear of a reservoir 39 in another embodiment and the inertance N of an ink supply passage 49 and an equivalent circuit of an ink passage provided with the compliance C and the inertance N.
Figure 7:
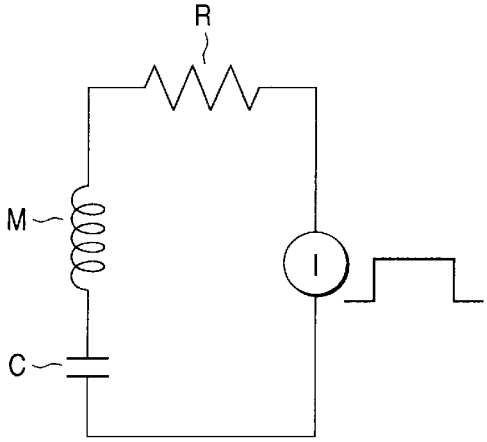

FIG. 7(A) shows the compliance C of the film 43 at the rear of the reservoir 39 and the inertance M of the ink supply passage 49 in this embodiment, and FIG. 7(B) shows the equivalent circuit of an ink passage provided with the above compliance C and the above inertance M. (R denotes the resistance due to viscosity, among other characteristics, of the passage, and I denotes the flow rate of ink).

In application of a stepped disturbance to the equivalent circuit shown in FIG. 7(B), inkjets from the pressure chamber 37 into the reservoir 39 when ink is jetted, and thereby, an MC circuit is oscillated. As is clear from circuit theory, the larger C is and the smaller N is, the smaller the pressure amplitude of oscillation is. In this embodiment, as described referring to FIGS. 4 and 5, as an area, in which the film 43 acts as compliant at the rear of the reservoir 39, is larger than an area in the conventional type head, and the wing-type aperture is not disconnected in the center as in the conventional type head, and C is larger than C in the conventional type head. As the ink supply passage 49 becomes thicker as it approaches the entrance, although the ink supply passage 49 is thin at the exit, M in the whole ink supply passage 49 is small. Therefore, pressure amplitude in the reservoir 39 is small and crosstalk is small.

Figure 8:
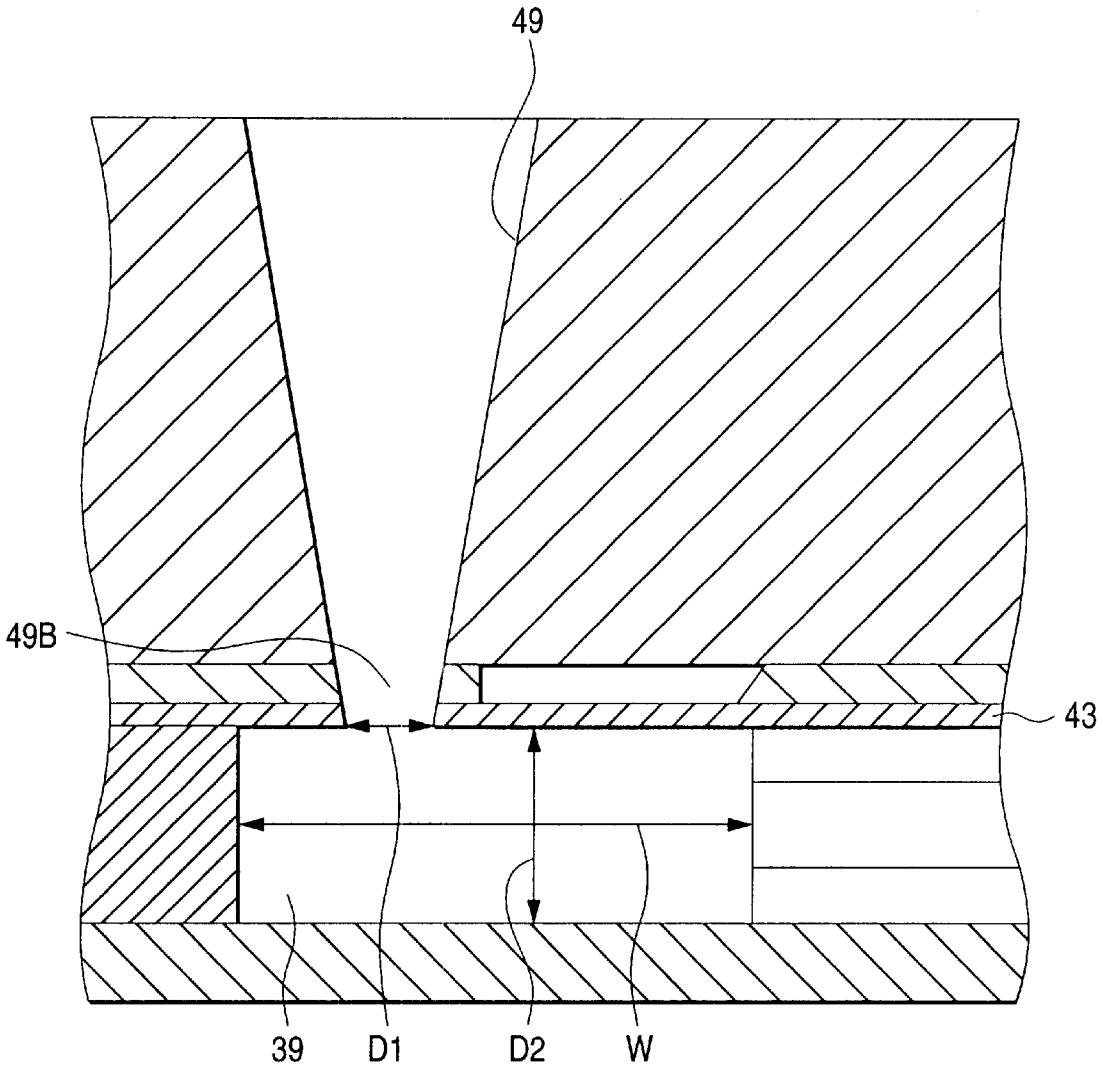
FIG. 8 shows the desirable dimensional relationship in another embodiment.

FIG. 8 shows a desirable dimensional relationship to produce the satisfactory results of preventing bubbles from remaining in the ink supply passage 49, and of reducing crosstalk, respectively as described above.

That is, it is desirable that the width (diameter) D1 at the exit 49B of the ink supply passage 49 is smaller than the depth D2 of the reservoir 39. As a result, bubbles which enter the reservoir 39 from the ink supply passage 49 can easily pass the reservoir 39. However, it is not necessarily required that D1 is smaller than D2 and even if D1 is larger than D2, bubbles do not remain if the flow velocity of ink is suitably fast. It is desirable that the width W of the reservoir 39 is larger than the width D1 at the exit of the ink supply passage 49 and if the width W of the reservoir 39 is larger than the depth D2 of the reservoir 39, it is further desirable. Hereby, the compliance of the film 43 at the rear of the reservoir increases and the effect of reducing crosstalk is increased.

Figure 9:
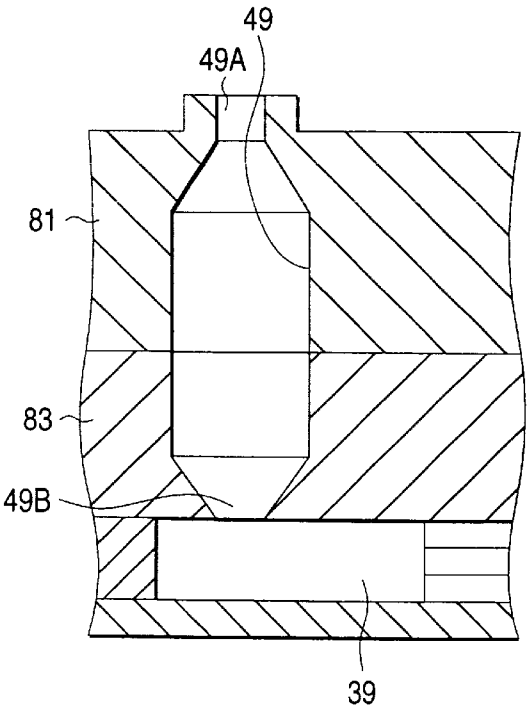
FIGS. 9(A)–9(C) show a few embodiments of the form or the structure of an ink supply passage 49 for which the principle of the present invention can be utilized.
Figure 9:
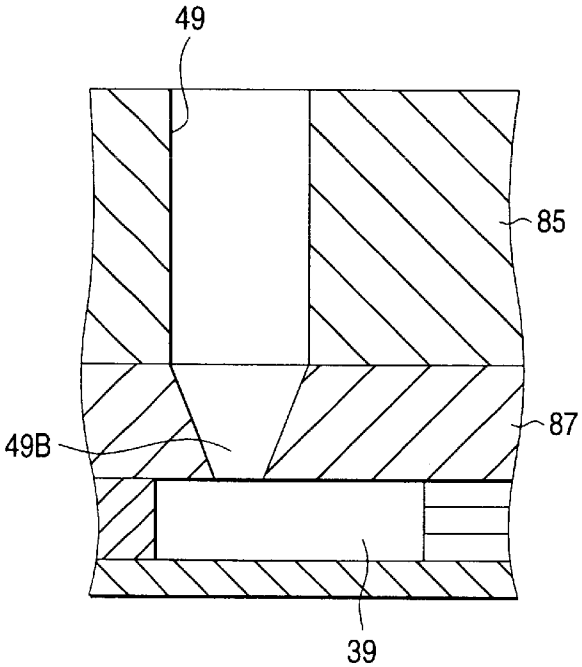
Figure 9:
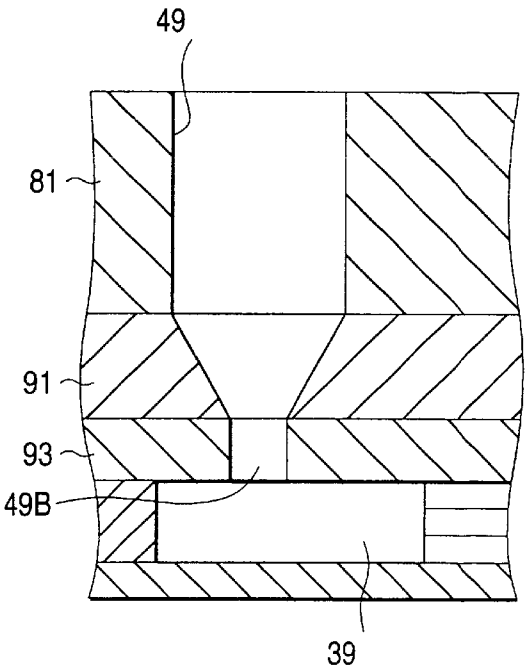

FIGS. 9(A)–9(C) show more embodiments of the form or the structure of an ink supply passage 49 in which the principle of the present invention can be utilized.

In an emobdiment shown in FIG. 9(A), an ink supply passage 49 is tapered in the vicinity of the entrance 49A and the exit 49B, is thin at the entrance 49A and the exit 49B, and the other part is thick and has the same diameter, and the ink supply passage is formed by bonding two members 81 and 83 in each of which an aperture in the above shape is formed. An ink supply passage 49 shown in FIG. 9(B) is tapered only at the exit 49B, is the thinnest at the exit 49B, the other part is thick and has the same diameter, and the ink supply passage 49 is formed by bonding two members 85 and 87 in each of which an aperture in the above shape is formed. An ink supply passage 49 shown in FIG. 9(C) is tapered on the slight upstream side of the exit 49B, the ink supply passage 40 at the exit 49B is the thinnest and has the same diameter, the ink supply passage 49 on the upstream side of the tapered part is thick and has the same diameter and the ink supply passage 49 is formed by bonding three members 89, 91, and 93, in each of which an aperture in the above shape is formed.

Figure 10:
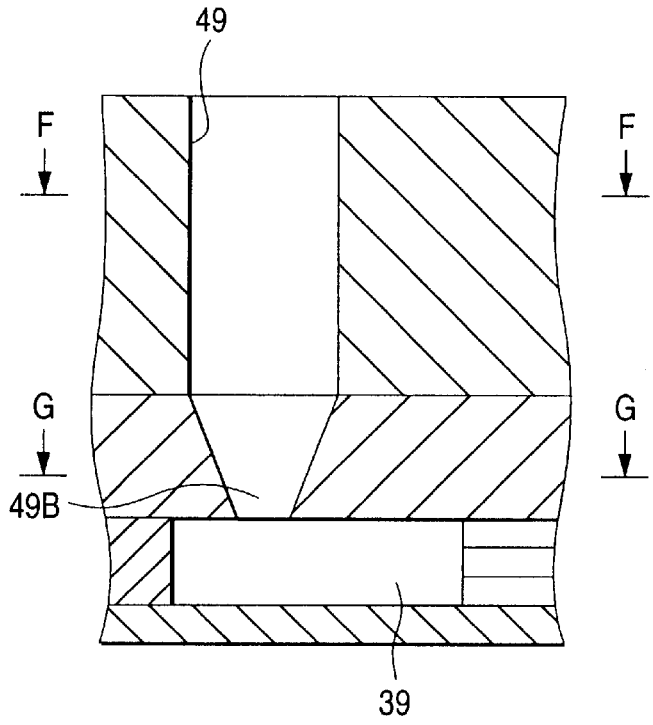
FIGS. 10(A)–10(C) show another embodiment of the present invention showing an ink supply passage 49.
Figure 10:
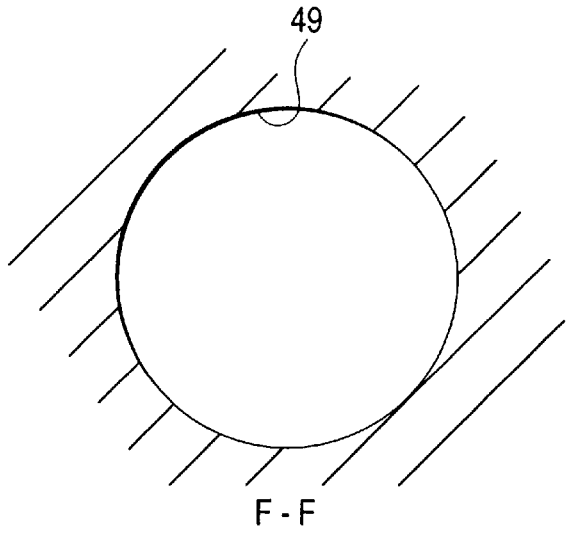
Figure 10:
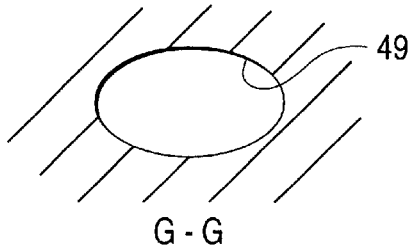

FIGS. 10(A)–(C) show another embodiment of an ink supply passage 49.

FIGS. 10(B) and 10(C) are sectional views showing the ink supply passage 49 respectively viewed along lines F—F and G—G in FIG. 10(A). The cross section of the ink supply passage 49 is elliptical at the exit 49B, the shape contributes to the increase of the compliance C of a film 43 at the rear of a reservoir 39, the cross-section of the other thick part of the ink supply passage 49 is circular and the shape contributes to minimizing the inertance M of the ink supply passage 49.

Figure 11:
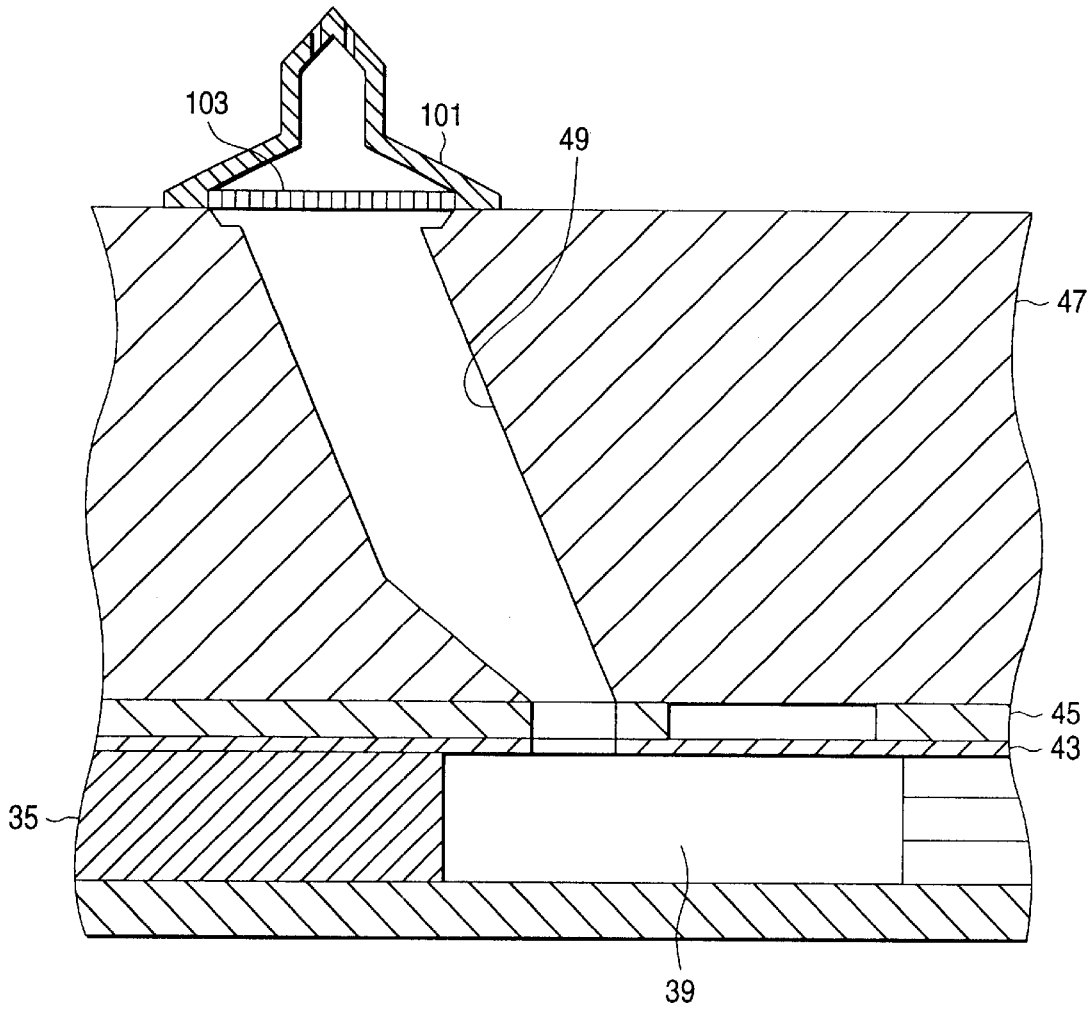
FIG. 11 shows further another embodiment showing an ink supply passage 49.

FIG. 11 shows further another embodiment of an ink supply passage 49.

The ink supply passage 49 diagonally pierces the casing 47 of a head, the ink supply passage 49 in the vicinity of the exit is tapered and the ink supply passage is the thinnest at the exit 49B. A reference number 101 denotes a needle inserted into an ink cartridge (not shown) and a reference number 103 denotes a filter for removing dust in the ink. As the ink cartridge is normally considerably larger than a reservoir 39, the ink supply passage 49 is diagonally arranged to lead ink from a predetermined location of the ink cartridge into the reservoir 39.

Figure 12:
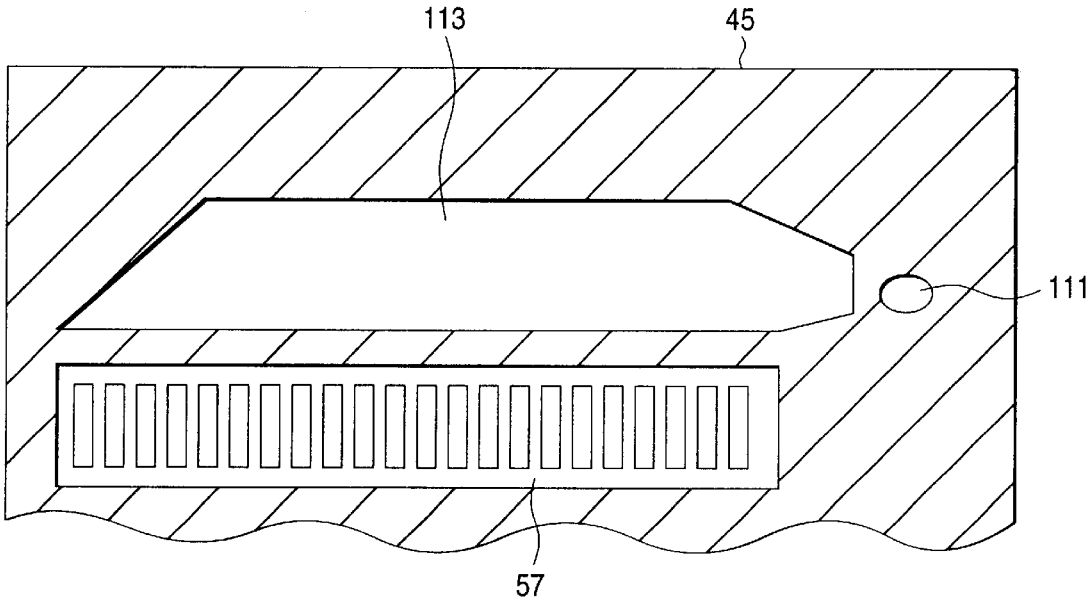
FIG. 12 is a sectional view showing an embodiment of a reinforcing plate 45 for explaining another layout of an ink supply passage.

FIG. 12 is a sectional view showing an embodiment of a reinforcing plate 45 for explaining another layout of an ink supply passage.

Inside the reinforcing plate 45, one end of an aperture 113 at the rear of an ink reservoir 39 is extended outside an aperture 57 at the rear of the line of pressure chambers 37 and an aperture 111 equivalent to the exit of the ink supply passage 49 is formed beside the extended end of the hole 113. This means that the ink reservoir 39 is extended to a place outside the line of the pressure chambers 37 and the exit of the ink supply passage 49 is connected to the extended part. According to the above arrangement, as the jet of ink from the pressure chambers 37 can be absorbed in the whole area of the reservoir 39 before the pressure chambers 37, the effect of the reduction of crosstalk is more enhanced. However, the size of the ink-jet print head 31 is increased by a quantity in which the ink supply passage 49 is arranged outside the line of the pressure chambers 37.

Figure 13:
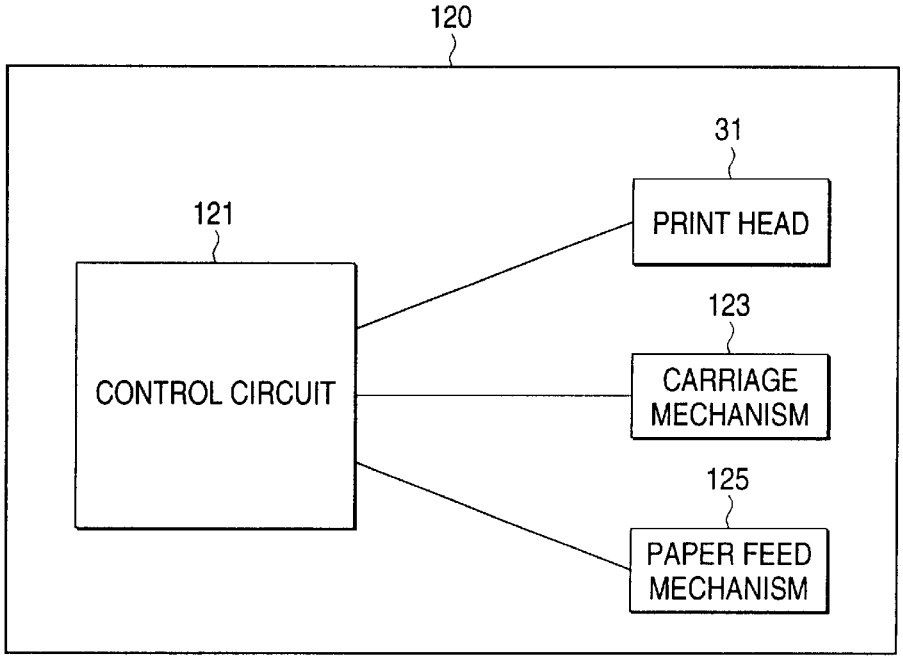
FIG. 13 is a block diagram showing the whole ink-jet printer using the ink-jet print head according to the present invention.

FIG. 13 shows the whole composition of an ink-jet printer using the ink-jet print head 31 equivalent to the above embodiment.

The printer 120 is provided with the ink-jet print head 31, constituted as described above, a carriage mechanism 123 for moving the ink-jet print head, a paper feed mechanism 125 for feeding paper, and a control circuit 121 for driving and controlling the ink-jet print head 121, carriage mechanism 123, and paper feed mechanism 125. Such a printer 120 can be used for the output device of a computer system, a facsimile, a printer for a word processor, a printer for an automated teller machine (ATM), and other devices.

It is contemplated that numerous modifications may be made to the apparatus and procedure of the invention without departing from the spirit and scope of the invention as defined in the following claims.

What is claimed is:

1. An ink-jet print head, comprising:

a plurality of ink jetting nozzles arranged in a line;

a plurality of pressure chambers respectively communicating with said nozzles and arranged in a line extending in a first direction;

an ink reservoir extended along the line of said pressure chambers, communicating with said plurality of pressure chambers in common, said ink reservoir being provided with a predetermined width and a predetermined depth; and an ink supply passage having an upstream side and a downstream side, said downstream side having an exit, the exit which communicates with said ink reservoir;

wherein at the exit to said ink reservoir, a cross-section of said ink supply passage is made smaller than a cross-section of a part of said ink supply passage on an upstream side of the exit; and wherein a flexible portion is superposed over said ink reservoir, and is continued overall from one end of said ink reservoir to the other end of said ink reservoir along the first direction.

2. An ink-jet print head according to claim 1, further comprising:

a flexible film which covers at least a part of an outer surface of said ink reservoir, said film being in a deformable state and acting so that pressure fluctuation of ink in said ink reservoir is absorbed thereby.

3. An ink-jet print head according to claim 1, further comprising:

a nozzle plate having nozzle openings;

a spacer bonded to a rear surface of said nozzle plate and forming said plurality of pressure chambers and said ink reservoir; and a flexible film bonded to said spacer for covering an area of at least a part of a rear surface of said ink reservoir, said film being in a deformable state and acting so that pressure fluctuation of ink in said ink reservoir is absorbed thereby, wherein the exit of said ink supply passage is arranged at a predetermined location of the rear surface of said ink reservoir.

4. An ink-jet print head according to any of claims 1 to 3, wherein a width at the exit of said ink supply passage is smaller than the width of said ink reservoir.

5. An ink-jet print head according to any of claims 1 to 3, wherein a width at the exit of said ink supply passage is smaller than the depth of said ink reservoir.

6. An ink-jet print head according to claim 2, wherein an area in which said film covers said ink reservoir in a deformable state continues at least from one end of the line of said pressure chambers, to the other end in a vicinity of said pressure chambers, along the line of said pressure chambers.

7. An ink-jet print head according to claim 3, wherein an area in which said film covers said ink reservoir in a deformable state continues at least from one end of the line of said pressure chambers to the other end in a vicinity of said pressure chambers along the line of said pressure chambers.

8. An ink-jet print head according to claim 6, wherein a width at the exit of said ink supply passage is smaller than the width of said ink reservoir.

9. An ink-jet head according to claim 7, wherein a width at the exit of said ink supply passage is smaller than the width of said ink reservoir.

10. An ink-jet print head according to any of claim 1 to 3, wherein the width of said ink reservoir is larger than the depth thereof.

11. An ink-jet print head according to any of claims 1 to 3, wherein a shape of the exit of said ink supply passage is approximately elliptical.

12. An ink-jet print head according to any one of claims 1 to 3, wherein a minimum width at the exit of said ink supply passage is smaller than the width of said ink reservoir.

13. The ink-jet print head as set forth in claim 1, further comprising:

a flexible film covering at least a part of an outer surface of said ink reservoir, said film being in a deformable state and acting so that pressure fluctuation of ink in said ink reservoir is absorbed thereby; and wherein an area in which said film covers said ink reservoir in a deformable state continues at least from one end of the line of said pressure chambers to the other end in a vicinity of said pressure chambers along the line of said pressure chambers.

14. The ink-jet print head as set forth in claim 1, wherein the exit of said ink supply passage is disposed adjacent to a reverse side of said ink reservoir in a center of said ink reservoir, wherein the reverse side is opposite to a side of the ink reservoir that is adjacent to said pressure chambers, wherein the exit of said ink supply passage is disposed closer to the reverse side of said ink reservoir than to the side of said ink reservoir that is adjacent to said pressure chambers.

15. The ink-jet print head as set forth in claim 1, wherein the exit of said ink supply passage is disposed directly adjacent to a reverse side of the ink reservoir in a center of said ink reservoir in a direction along the line of said pressure chambers, wherein the reverse side is opposite to a side of the ink reservoir that is adjacent to said pressure chambers; and wherein a width at the exit of said ink supply passage is smaller than the width of said ink reservoir.

16. An ink-jet printer, comprising:

an ink-jet print head;

a carriage mechanism for moving said ink-jet print head;

a paper feed mechanism for feeding paper; and a control circuit for driving and controlling said ink-jet print head, said carriage mechanism and said paper feed mechanism;

wherein said ink-jet print head comprises:

a plurality of ink jetting nozzles arranged in a line;

a plurality of pressure chambers respectively communicating with said nozzles and arranged in a line extending in a first direction;

an ink reservoir extended along the line of said pressure chambers, communicating with said plurality of pressure chambers in common and provided with a predetermined width and a predetermined depth; and an ink supply passage having an upstream side and a downstream side, said downstream side having an exit which communicates with said ink reservoir;

wherein a diameter of said ink supply-passage at the exit to said ink reservoir is smaller than a diameter of said ink supply passage on the upstream side of said exit; and wherein a flexible portion is superposed over said ink reservoir, and is continued overall from one end of said ink reservoir to the other end of said ink reservoir along the first direction.

17. The ink-jet printer as set forth in claim 16, further comprising:

a flexible film covering at least a part of the outer surface of said ink reservoir, said film being in a deformable state and acting so that pressure fluctuation of ink in said ink reservoir is absorbed thereby; and wherein an area in which said film covers said ink reservoir in a deformable state continues at least from one end of the line of said pressure chambers to the other end in a vicinity of said pressure chambers along the line of said pressure chambers.

18. The ink-jet printer as set forth in claim 16, wherein the exit of said ink supply passage is disposed adjacent to a reverse side of said ink reservoir in a center of said ink reservoir, wherein the reverse side is opposite to a side of said ink reservoir that is adjacent to said pressure chambers, and wherein the exit of said ink supply passage is disposed closer to the reverse side of said ink reservoir than to the side of said ink reservoir that is adjacent to said pressure chambers.

19. The ink-jet printer as set forth in claim 16, wherein the exit of said ink supply passage is disposed directly adjacent to a reverse side to a side of said ink reservoir in a center of said ink reservoir in a direction along the line of said pressure chambers, wherein the reverse side is opposite to a side of said ink reservoir that is adjacent to said pressure chambers; and wherein a width at the exit of said ink supply passage is smaller than the width of said ink reservoir.

20. The ink-jet print head as claimed in claim 1, wherein said cross-section of said ink supply passage is tapered from said upstream side to said exit.

21. The ink-jet print head as claimed in claim 20, wherein said ink supply passage is substantially conical-shaped.

22. The ink-jet printer as claimed in claim 16, wherein said cross-section of said ink supply passage is tapered from said upstream side to said exit.

23. The ink-jet printer as claimed in claim 22, wherein said ink supply passage is substantially conical-shaped.

24. The ink-jet print head as set forth in claim 1, wherein said flexible portion includes a chamber being fluidly disconnected from said ink reservoir.

25. The ink-jet print head as set forth in claim 1, further comprising a reinforcing plate placed on said ink reservoir, wherein said flexible portion includes an absorbing portion formed on said reinforcing plate so as to absorb pressure fluctuation of ink in said ink reservoir.

26. The ink-jet print head as set forth in claim 25, wherein said absorbing portion includes a through-hole portion formed on said reinforcing plate.

27. The ink-jet printer as set forth in claim 16, wherein said flexible portion includes a chamber being fluidly disconnected from said ink reservoir.

28. The ink-jet printer as set forth in claim 16, further comprising a reinforcing plate placed on said ink reservoir, wherein said flexible portion includes an absorbing portion formed on said reinforcing plate so as to absorb pressure fluctuation of ink in the ink reservoir.

29. The ink-jet printer as set forth in claim 28, wherein said absorbing portion includes a through-hole portion formed on said reinforcing plate.

* * * * *